US008390461B2

(12) United States Patent
Dubois et al.

(10) Patent No.: US 8,390,461 B2
(45) Date of Patent: Mar. 5, 2013

(54) DEVICE FOR COUNTING AND DETERMINING THE DIRECTION OF PASSAGE OF LIVING BEINGS TAKING TEMPERATURE INTO ACCOUNT AND USING PYROELECTRIC CELLS

(75) Inventors: Jean-Claude Dubois, Lannion (FR); Christophe Milon, Saint Michel en Greve (FR)

(73) Assignee: Eco Computeur, Lannion (FR)

( * ) Notice: Subject to any disclaimer, the term of this patent is extended or adjusted under 35 U.S.C. 154(b) by 594 days.

(21) Appl. No.: 12/294,776

(22) PCT Filed: Mar. 22, 2007

(86) PCT No.: PCT/EP2007/002558
§ 371 (c)(1),
(2), (4) Date: May 20, 2010

(87) PCT Pub. No.: WO2007/110193
PCT Pub. Date: Oct. 4, 2007

(65) Prior Publication Data

US 2010/0225486 A1 Sep. 9, 2010

(30) Foreign Application Priority Data

Mar. 27, 2006 (FR) ..... 06 02665

(51) Int. Cl.
*G08B 21/00* (2006.01)

(52) U.S. Cl. ..... 340/573.1; 340/540; 250/342; 377/6

(58) Field of Classification Search ..... 340/573.1, 340/540; 377/6, 45, 55; 250/342, 353
See application file for complete search history.

(56) References Cited

U.S. PATENT DOCUMENTS

| | | | |
|---|---|---|---|
| 4,000,400 | A | 12/1976 | Elder |
| 4,278,878 | A | 7/1981 | Kato |

FOREIGN PATENT DOCUMENTS

| | | | |
|---|---|---|---|
| EP | 0 828 233 | A2 | 3/1998 |
| FR | 2 644 269 | | 9/1990 |
| WO | WO 01/88858 | A1 | 11/2001 |

*Primary Examiner* — Jeffery Hofsass
(74) *Attorney, Agent, or Firm* — Gerald E. Helget; Briggs and Morgan, P.A.

(57) ABSTRACT

A device for counting and determining the direction of passage of living beings. A first cell delivers an electrical signal representing the passage of a living being. A second pryoelectric cell delivers a second electrical signal. A processing unit analyzes the signals and determines the number of living beings moving past and their direction of movement.

5 Claims, 4 Drawing Sheets

DEVICE FOR COUNTING AND DETERMINING THE DIRECTION OF PASSAGE OF LIVING BEINGS TAKING TEMPERATURE INTO ACCOUNT AND USING PYROELECTRIC CELLS

CROSS REFERENCE TO RELATED APPLICATIONS

The present application is based on and claims priority to International Application PCT/EP2007/002558 filed on Mar. 22, 2007 and French Patent Application No. 06/02665 filed on Mar. 27, 2006, the contents of which are hereby incorporated by reference in their entirety.

BACKGROUND OF THE INVENTION

The invention concerns a device for counting and determining the direction of passage of living beings. It finds its application in the field of counting and determining the direction of passage of persons on paths or in buildings. However, it can also apply to the counting and determination of the direction of passage of animals on paths.

FIG. 1 depicts a device for determining the direction of passage 100 of a living being 114 of the prior art, which comprises a pyroelectric cell 102 and a processing unit (not shown).

The pyroelectric cell 102 is of the type comprising a first detection window 104 and a second detection window 106 disposed, horizontally, alongside each other. The pyroelectric cell 102 and in particular the first detection window 104 and the second detection window 106 are sensitive to infrared radiation, and the pyroelectric cell 102 delivers an electrical signal 200 representing the passage of the living being 114 in front of the detection windows 104 and 106. The electrical signal 200 is shown in FIG. 2*a*.

The processing unit is connected to the pyroelectric cell 102 and receives the electrical signal 200 thus delivered and, from the analysis of this electrical signal 200, it determines the direction of passage of the living being 114 in front of the device for determining the direction of passage 100.

The parallelepipeds 110 and 112 of FIG. 1 represent the zones of influence of the detection windows 104 and 106. That is to say infrared radiation emitted inside the first zone of influence 110 is perceived by the first detection window 104 and infrared radiation emitted inside the second zone of influence 112 is perceived by the second detection window 106.

The arrow 116 represents the direction of passage of the living being 114.

The electrical signal 200 represents the electrical signal delivered by the pyroelectric cell 102 during the passage of the living being 114 in front of the pyroelectric cell 102. The arrow 210*a* represents the direction of passage of the living being 114. In the example in FIG. 2*a*, the arrow 210*a* repeats the direction of the arrow 116 in FIG. 1.

The maximum 202 represents the detection by the first detection window 104 of the passage of the living being 114 and the minimum 204 represents the detection by the second detection window 106 of the passage of the living being 114. The secondary minimum 206 and the secondary maximum 208 represent the damping of the signal and depend on the elements making up the pyroelectric cell 102 and the processing unit.

If the living being 114 moves in a direction opposite to that of the arrow 116, the electrical signal 200 is reversed, that is to say the signal passes first of all through the minimum 204 representing the passage of the living being 114 in front of the second detection window 106 and then a maximum 202 representing the passage of the living being 114 in front of the first detection window 104. Such an electrical signal is depicted at FIG. 2*b*. The direction of passage of the living being 114 is then represented by the arrow 210*b*.

The determination of the direction of passage of the living being 114 in front of the device for determining the direction of passage 100 therefore seems to be able to take place by analysis of the electrical signal 200.

The problem with the device 100 of the prior art is that in fact, this determination is accurate only if the temperature of the living being 114 is greater than that of the device for determining the direction of passage 100.

This is because, if the temperature of the living being 114 is lower than that of the device for determining the direction of passage 100, the curves in FIGS. 2*a* and 2*b* are reversed and there is then a lack of determination of the direction of passage of the living being 114.

Thus, because of the reversal of the difference in temperature between the living being 114 and the device for determining the direction of passage 100, there arises uncertainty with regard to the direction of passage of the living being 114 in front of the device for determining the direction of passage 100. Such a reversal in the difference in temperature may exist when the device for determining the direction of passage 100 is placed in a heated corridor and the living being 114 comes from a place where the temperature is lower, for example outside, and his garments are cold.

In addition, such a device for determining the direction of passage 100 does not make it possible to count the number of living beings 114 passing in front of it.

BRIEF SUMMARY OF THE INVENTION

An object of the present invention is therefore to propose a device for counting and determining the direction of passage of living beings that does not have the drawbacks of the prior art, allowing counting of living beings as well as an exact determination of the direction of passage of the living beings.

To this end, there is proposed a device for counting and determining the direction of passage of living beings comprising:

- a first pyroelectric cell adapted to deliver an electrical signal of a first type representing the infrared radiation emitted by a living being passing in front of said first cell;
- a second pyroelectric cell of the type comprising a first detection window and a second detection window and adapted to deliver an electrical signal of a second type representing the direction of passage of the living being in front of said second pyroelectric cell the first cell and the second pyroelectric cell being one above the other; and
- a processing unit adapted to determine firstly the number of living beings passing in front of said device, by analysing the electrical signal of the first type, and secondly the direction of passage of the living beings passing in front of said device by analysing the electrical signal of the first type and the electrical signal of the second type.

According to a particular embodiment, the first cell is a pyroelectric sensor of the type comprising a first detection window and a second obscured detection window.

According to a particular embodiment, the determination of the direction of passage of the living beings passing in front of said device consist of analysing the level of the electrical signal of the second type at the moment when the living being leaves the cone of influence of the first detection window of the first cell.

Advantageously, the device for counting and determining the direction of passage comprises a cylindrical Fresnel lens disposed in front of each cell.

Advantageously, for each cell, the position of the focus of the Fresnel lens is such that the infrared radiation emitted by each living being is focussed substantially between the two detection windows of the cell in question.

BRIEF DESCRIPTION OF THE DRAWINGS

The characteristics of the invention mentioned above, as well as others, will emerge more clearly from a reading of the following description of an example embodiment, the said description being given in relation to the accompanying drawings, among which.

DETAILED DESCRIPTION OF THE INVENTION

Figure 1:
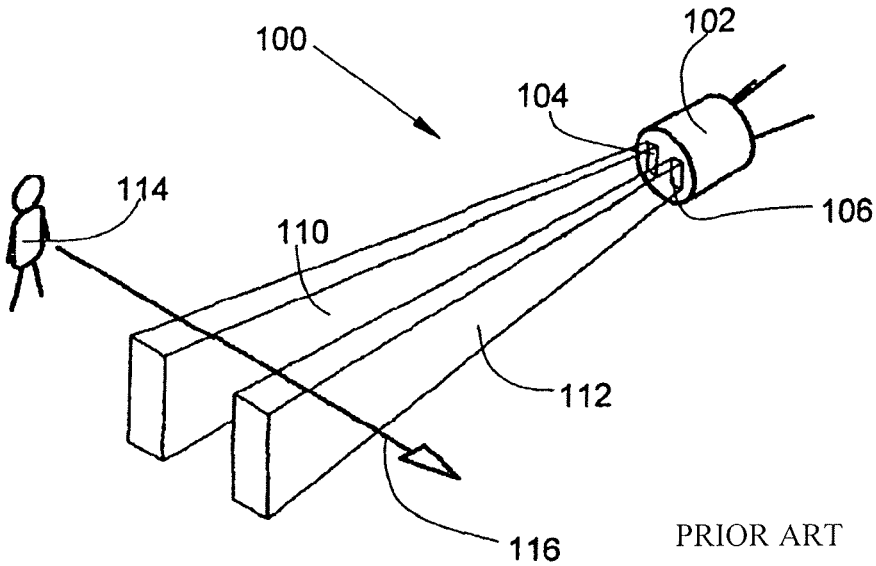
FIG. 1 depicts a device for determining the direction of passage of a living being of the prior art.
Figure 2A:
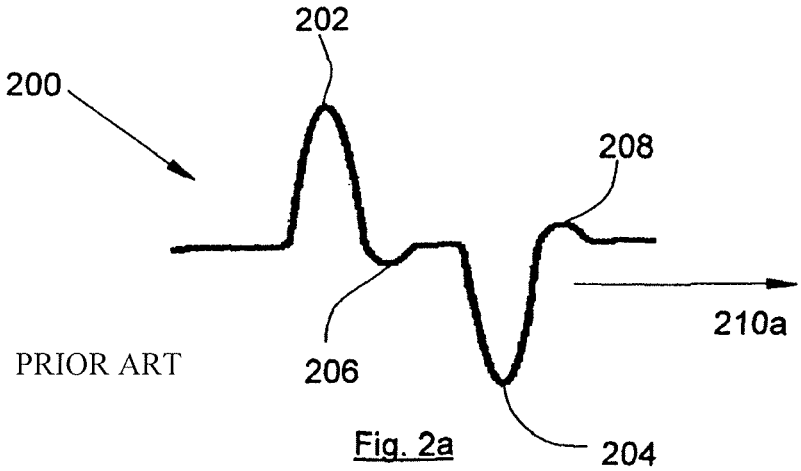
FIG. 2*a* and FIG. 2*b* depict curves representing the signal output from the pyrotechnic cell of the prior art.
Figure 2B:
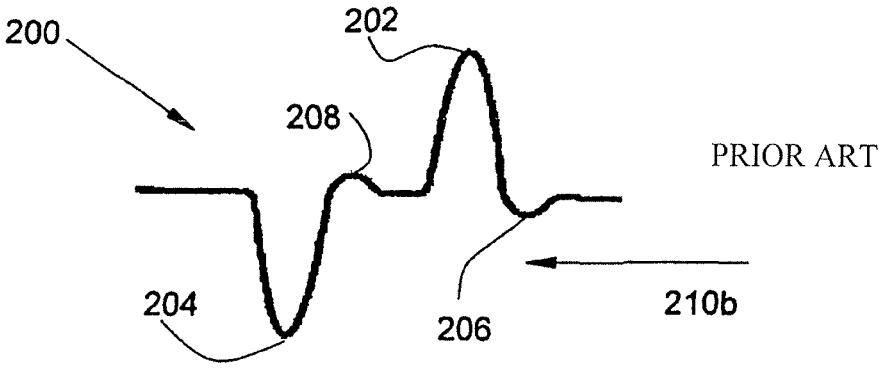
Figure 3:
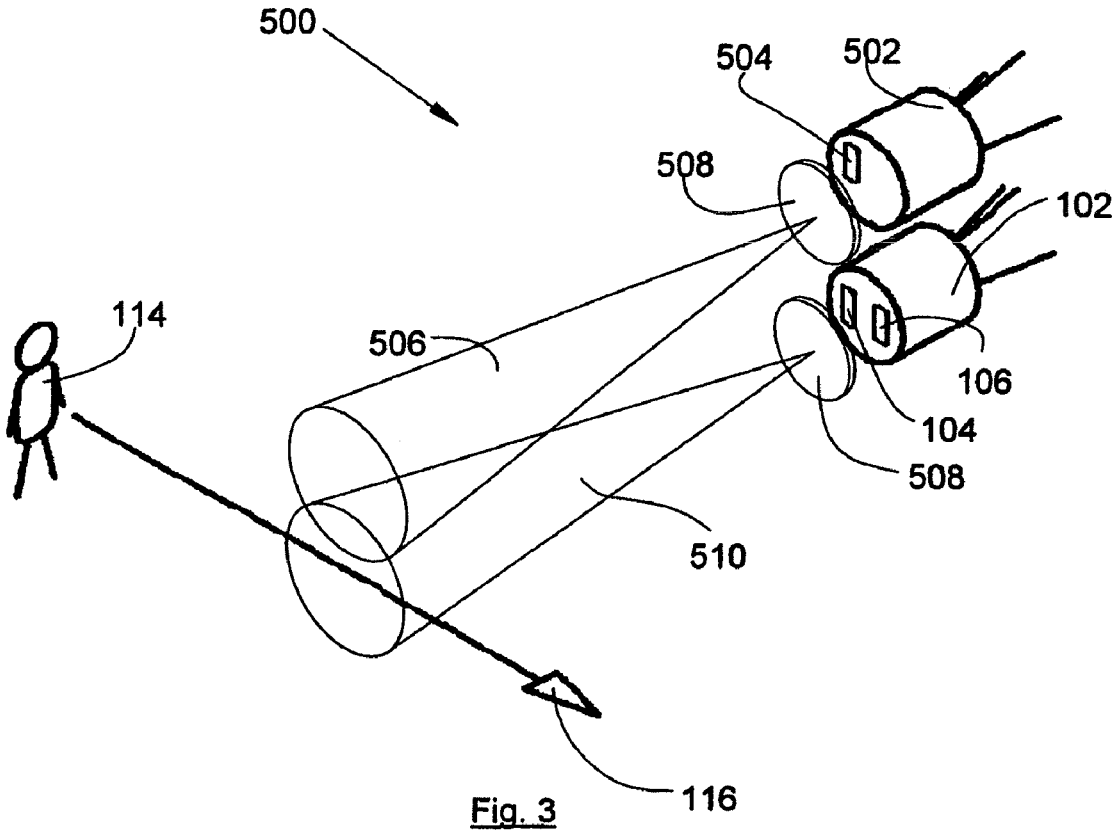
FIG. 3 depicts a device for counting and determining the direction of passage of a living being according to the invention.

FIG. 3 depicts a device for counting and determining the direction of passage 500 of a living being 114 according to the invention. The elements identical to the device for determining the direction of passage 100 of the prior art bear the same references.

Thus the device for counting and determining the direction of passage 500 according to the invention comprises:

- a first cell 502 adapted to deliver an electrical signal of a first type representing the passage of a living being 114 in front of the first cell 502;
- a second pyroelectric cell 102 of the type comprising a first detection window 104 and a second detection window 106 and adapted to deliver an electrical signal of a second type representing the direction of passage of the living being 114 in front of the second pyroelectric cell 102; and
- a processing unit adapted to determine firstly the number of living beings passing in front of the device 500 by analysing the electrical signal of the first type and secondly the direction of passage of the living beings 114 passing in front of the device 500 by analysing the electrical signal of the first type and the electrical signal of the second type.

According to a particular embodiment of the invention depicted in FIG. 3, the first cell 502 is a pyroelectric sensor 502 of the type comprising a first detection window 504 and a second obscured detection window.

In FIG. 3, the first cell 502 and second cell 102 are disposed close to each other and one above the other.

The detection windows 104, 106 and 504 are oriented vertically and the detection windows 104 and 106 of the second cell 102 are disposed, horizontally, one alongside the other.

So that the vision angle of each cell 102, 502 is not too extensive and therefore that each cell 102, 502 is solely influenced by a single living being 114 passing in front of the device 500, the latter comprises, for each cell 102, 502, a cylindrical Fresnel lens 508 disposed in front of each cell 102, 502. Advantageously, for each cell 102, 502, the position of the focus of the Fresnel lens 508 is such that the infrared radiation emitted by the living being 114 is focussed substantially between the two detection windows 104, 106, 504 of the cell 102, 502 in question.

The cone 506 represents the cone of influence of the first cell 502 and in particular of the first detection window 504 of the first cell 502, that is to say any living being 114 entering this cone 506 is seen by the first cell 502.

The cone 510 represents the cone of influence of the second cell 102, that is to say any living being 114 entering this cone 510 is seen by the second cell 102 and in particular by the first detection window 104 and the second detection window 106.

To allow better detection of each living being 114 passing the device 500, and to avoid the passage of a plurality of living beings 114 being analysed as the passage of single living being 114, the angle of each cone of influence 506, 510 is reduced to the maximum possible extent.

In addition, the fact that the first cell 502 and the second cell 102 are disposed one above the other makes it possible to align the cone 506 and the cone 510 vertically. Thus a single living being 114 influences simultaneously the first cell 502 and the second cell 102 and, when the living being 114 leaves one of the cones 506 or 510, it also leaves the other cone 510 or 506. Thus, when the living being 114 no longer influences one of the cells 502 or 102, it no longer influences the other cell 102 or 502 respectively, which avoids faulty counting or faulty determination of the direction of passage.

This particular arrangement also makes it possible to obtain a compact device for counting and determining the direction of passage 500.

Figure 5A:
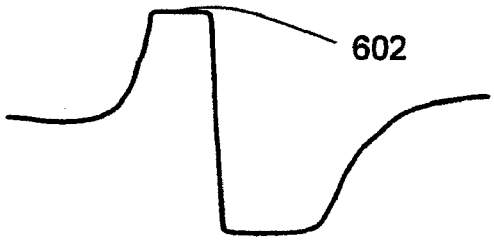
FIG. 5*a* and FIG. 5*b* depict the curves representing the signal output from the first cell of the device for counting and determining the direction of passage of a living being according to the invention.
Figure 5B:
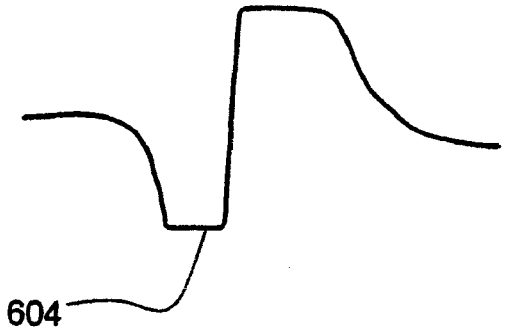

FIG. 5*a* and FIG. 5*b* depict the curves representing the signal output from the first cell 502 of the device for counting and determining the direction of passage 500, that is to say the electrical signal of the first type.

FIG. 5*a* depicts the curve 602 when the external surfaces of the living being 114 are at a temperature lower than that of the device 500. The curve 602 has a maximum that corresponds to the passage of the living being 114 in the cone of influence 506, then an abrupt variation (here a drop) corresponding to the fact that the living being 114 leaves the cone of influence 506, and then a return to the initial level.

FIG. 5*b* depicts the curve 604 when the external surfaces of the living being 114 are at a temperature greater than that of the device 500. The curve 604 has minimum that corresponds to the passage of the living being 114 in the cone of influence 506, and an abrupt variation (here a rise) corresponding to the fact that the living being 114 leaves the cone of influence 506, and then a return to the initial level.

The processing unit can thus, by analysing the signal received from the first cell 502, count the number of living beings 114 passing in front of the device 500 by incrementing a counter. In fact, in order to count a living being 114, the processing unit analyses the electrical signal of the first type and increments the counter when it detects a first variation (rise 602 or fall 604) from the initial level, and then a second variation in a direction opposite to the first variation (fall or rise).

From the analysis of the signal received from the first cell 502, the processing unit can thus determine whether the temperature of the living being 114 is less than or greater than that of the device 500. The first cell 502 therefore fulfils a role of counting and temperature sensing cell that delivers an electrical signal representing the difference in temperatures between the device 500 and the living being 114.

FIGS. 4*a*, 4*b*, 4*c* and 4*d* are the curves 310*a*, 310*b*, 410*a* and 410*b* representing the signal output from the second pyroelectric cell 102 of the device for counting and determining the direction of passage of a living being 500, that is to say the electrical signal of the second type. These curves 310*a*, 310*b*, 410*a* and 410*b* have a less sharp profile than the curves 602 and 604 because they result from a combination of the electrical signals coming from the first detection window 104 and the second detection window 106 of the second cell 102. In particular, the zone of return to the initial value of each of these curves 310*a*, 310*b*, 410*a* and 410*b* is disturbed.

The curve 310*a* represents the passage of a living being 114 whose temperature is less than that of the device 500 in a first direction represented by the arrow 300*a*.

The curve 310*b* represent the passage of a living being 114 whose temperature is less that that of the device 500 in a second direction represented by the arrow 300*b*.

The curve 410*a* represents the passage of a living being 114 whose temperature is greater than that of the device 500 in the first direction represented by the arrow 400*a*, which is identical to the direction of the arrow 300*a*.

The curve 410*b* represents the passage of a living being 114 whose temperature is greater than that of the device 500 in the second direction represented by the arrow 400*b*, which is identical to the direction of the arrow 300*b*.

The analysis, by the processing unit, of the signal of the first type and of the signal of the second type thus makes it possible to determine the direction of passage of the living being 114 in front of the device 500.

The curve 310*a* has a maximum 302 that corresponds to the passage of the living being 114 in front of the first detection window 104 and then an abrupt drop and a minimum 304 that corresponds to the passage of the living being 114 in front of the second detection window 106, then an abrupt rise that corresponds to the fact that the living being 114 emerges from the cone of influence 510, and then a return to the initial level.

The curve 310*b* has an arrangement reversed with respect to the curve 310*a*, that is to say it has the minimum 304 that corresponds to the passage of the living being 114 in front of the second detection window 106, then an abrupt rise and the maximum 302 that corresponds to the passage of the living being 114 in front of the first detection window 104, then an abrupt drop that corresponds to the fact that the living being 114 leaves the cone of influence 510, and then a return to the initial level.

The curve 410*a* has a minimum 402 that corresponds to the passage of the living being 114 in front of the first detection window 104, then an abrupt rise and a maximum 404 that corresponds to the passage of the living being 114 in front of the second detection window 106, then an abrupt drop that corresponds to the fact that the living being 114 emerges from the cone of influence 510, and then a return to the initial level.

The curve 410*b* has an arrangement reversed with respect to the curve 410*a*, that is to say it has the maximum 404 that corresponds to the passage of the living being 114 in front of the second detection window 106, then an abrupt fall and the minimum 402 that corresponds to the passage of the living being 114 in front of the first detection window 104, then an abrupt rise that corresponds to the fact that the living being 114 leaves the cone of influence 510, and then a return to the initial level.

As described above, apart from the electrical signal of the second type delivered by the second pyroelectric cell 102 and representing the direction of passage of the living being 114 in front of the detection windows 104 and 106, the processing unit receives the electrical signal of the first type delivered by the first cell 502 and representing the passage of the living being 114 in front of the detection window 504. Thus the processing unit receives both one of the electrical signals of the first type, depicted in FIG. 5*a* or 5*b*, and one of the electrical signals of the second type, depicted in FIGS. 4*a*, 4*b*, 4*c* or 4*d*.

After analysis of the electrical signal of the first type (FIG. 5*a*, FIG. 5*b*), received from the first cell 502, the processing unit determines whether the temperature of the living being 114 is greater than or less than that of the device for counting and determining the direction of passage 500.

Analysis of the electrical signal of the second type then makes it possible to determine the direction of passage of the living being 114. In fact the determination of the temperature of the living being 114 compared with that of the device for counting and determining the direction of passage 500 limits the analysis to two of the four curves depicted in FIGS. 4*a*, 4*b*, 4*c* and 4*d*.

Figure 4A:
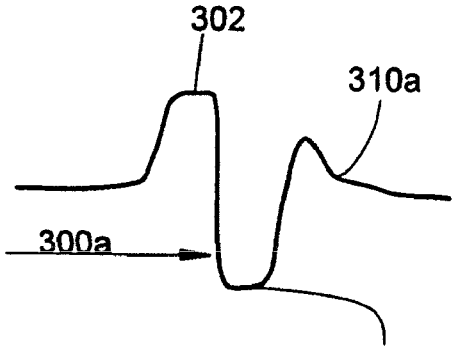
FIG. 4*a*, FIG. 4*b*, FIG. 4*c* and FIG. 4*d* are the various curves representing the signal output from the second pyroelectric cell of the device for counting and determining the direction of passage of a living being according to the invention.
Figure 4B:
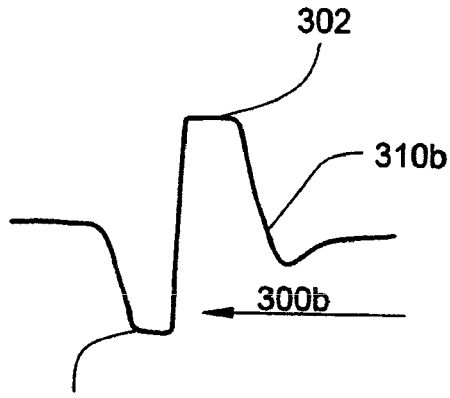

If the temperature of the living being 114 is less than that of the device for counting and determining the direction of passage 500, the direction of passage of the living being 114 is given by the arrow 300*a* in FIG. 4*a*, or by the arrow 300*b* in FIG. 4*b*. If the signal of the second type is similar to the curve in FIG. 4*a*, that is to say the curve passes first of all through the maximum 302 and then through the minimum 304, then the direction of passage is given by the arrow 300*a*. If the signal of the second type is similar to the curve in FIG. 4*b*, that is to say the curve passes first of all through the minimum 304 then through the maximum 302, then the direction of passage is given by the arrow 300*b*.

Figure 4C:
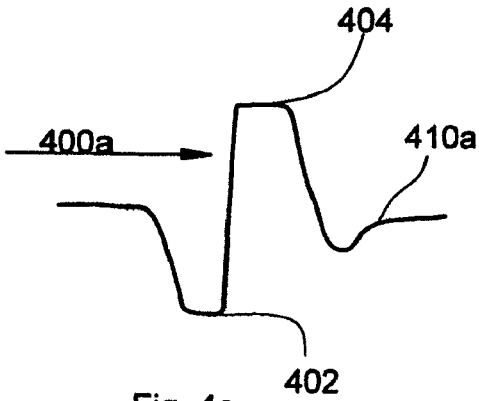
Figure 4D:
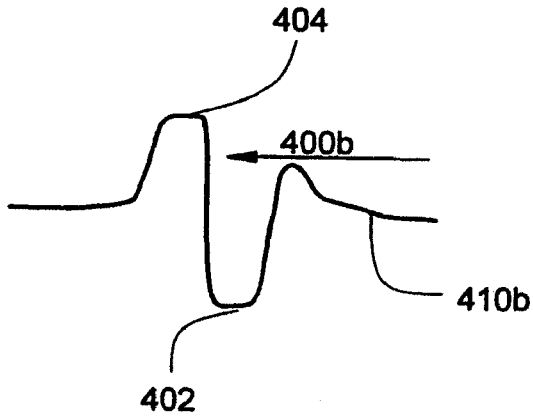

If the temperature of the living being 114 is greater than that of the device for counting and determining the direction of passage 500, the direction of passage of the living being 114 is given by the arrow 400 of FIG. 4*c*, or by the arrow 400*b* in FIG. 4*d*. If the signal of the second type is similar to the curve in FIG. 4*c*, that is to say the curve passes first of all through the minimum 402 and then through the maximum 404, then the direction of passage is given by the arrow 400*a*. If the signal of the second type is similar to the curve in FIG. 4*d*, that is to say the curve passes first of all through the maximum 404 and then through the minimum 402, then the direction of passage is given by the arrow 400*b*.

The various combinations between the signal of the second type output from the second pyroelectric cell 102 and the signal of the first type output from the first cell 502 of the device for counting and determining the direction of passage of a living being 500, are represented by the curves in FIGS. 6*a*, 6*b*, 6*c* and 6*d*.

Thus knowledge of the temperature of the living being 114, compared with that of the device for counting and determining the direction of passage 500, makes it possible to determine precisely the direction of passage of the living being 114.

As described above, the processing unit is adapted to count the number of living beings 114 who have passed in front of the device 500. According to a particular embodiment, the processing unit counts, in a first register, the number of living beings 114 who have passed in the direction of the arrows 300*a* and 400*a* and, in a second register, the number of living beings 114 who have passed in the direction of the arrows 300*b* and 400*b*.

For FIGS. 6*a*, 6*b*, 6*c* and 6*d*, the first cell 502 and the second cell 102 are disposed one above the other, and the first detection window 504 of the first cell 502 is disposed substantially on the same vertical axis as the first detection window 104 of the second cell 102.

Figure 6A:
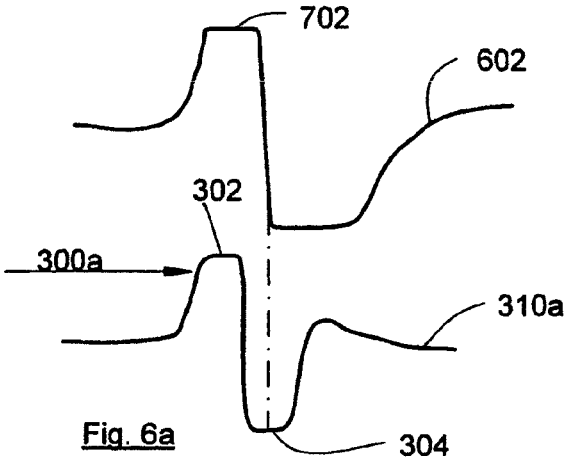
FIGS. 6*a*, 6*b*, 6*c* and 6*d* depict the combination of curves representing the signal output from the second pyroelectric cell and the curves representing the signal output from the first cell of the device for counting and determining the direction of passage of a living being according to a particular embodiment of the invention.

FIG. 6*a* depicts the passage of a living being 114 whose external temperature is less than that of the device for counting and determining the direction of passage 500, and which passes in front of the said device 500 in the direction represented by the arrow 300*a*.

The living being 114 thus first of all passes in front of the first detection window 504, 104 of each cell 502, 102 generating a first maximum 702 on the curve 602 and the second maximum 302 on the curve 310*a*. During the forward movement of the living being 114, the influence of it is felt at the second detection window 106 of the second cell 102, represented here by the drop between the maximum 302 and the minimum 304. The minimum 304 then represents the moment when the living being 114 influences mainly the second detection window 106 of the second cell 102. During this passage from the maximum 302 to the minimum 304, the living being 114 leaves the cone of influence 506 of the first detection window 504, which generates a rapid variation (here a drop) in the signal delivered by the first cell 502. At the end of the rapid variation, the curve 310*a*, representing the signal of the second type, is at the minimum 304, that is to say the living being 114 is situated in front of the second detection window 106 of the second cell 102. Thus the determination of the direction of passage of the living being 114 passing in front of the device 500 can be determined by analysing the level of the electrical signal of the second type, at the moment when the living being 114 leaves the cone of influence 506 of the first detection window 504 of the first cell 502.

Figure 6B:
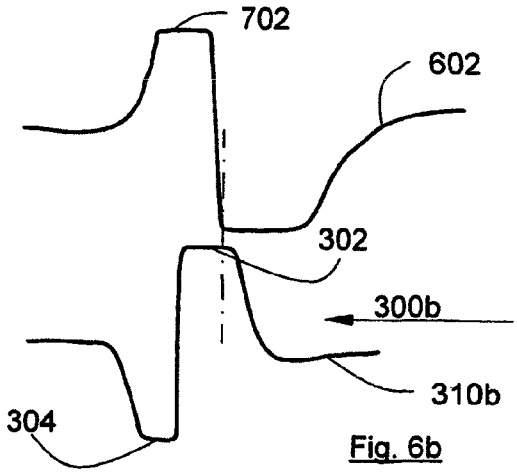

FIG. 6*b* represents the passage of a living being 114 whose external temperature is less than that of the device for counting and determining the direction of passage 500 and that passes in front of the said device 500 in the direction represented by the arrow 300*b*.

Figure 6C:
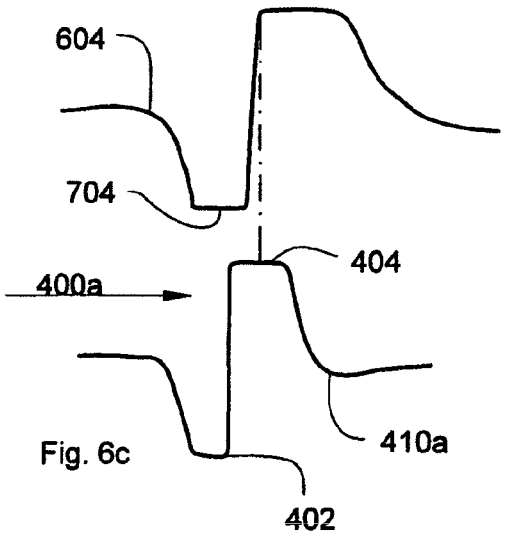

FIG. 6*c* represents the passage of a living being 114 whose external temperature is greater than that of the device for counting and determining the direction of passage 500 and passes in front of the said device 500 in the direction represented by the arrow 400*a*.

Figure 6D:
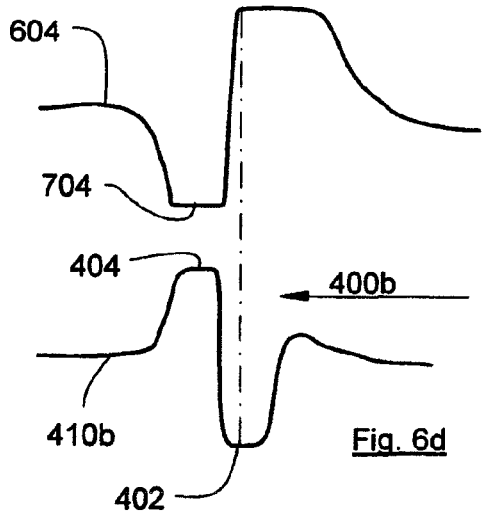

FIG. 6*d* represents the passage of a living being 114 whose external temperature is greater than that of the device for counting and determining the direction of passage 500 and who passes in front of the said device 500 in the direction represented by the arrow 400*b*.

FIGS. 6*b*, 6*c* and 6*d* are equivalent to FIG. 6*a*, and each shows the variations in the electrical signal of the second type which are coordinated with those of the electrical signal of the first type. In particular, when the living being 114 leaves the cone of influence 506 of the first detection window 504, this generates a rapid variation (a drop or rise) in the signal delivered by the first cell 502 and, at the end of this rapid variation, the curve representing the electrical signal of the second type 310*b*, 310*c* and 310*d* is at the minimum 402 or maximum 302, 404, that is to say the living being 114 is situated in front of the second detection window 106 of the second cell 102 or in front of the first detection window 104 of the second cell 102.

Thus, in general terms, the determination of the direction of passage of the living being 114 passing in front of the device 500 consists of analysing the level of the electrical signal of the second type at the moment when the living being 114 leaves the cone of influence 506 of the first detection window 504 of the first cell 502. In other words, when the thermal mass represented by the living being 114 leaves the cone of influence 506 of the first detection window 504 of the first cell 502, the signal of the first type and also its representative curve 602 or 604 have a rising or falling edge that is sharp and very short in time. This instant then represents a remarkable event. Analysis of the signal of the second type of this instant makes it possible to determine the direction of passage of the living being 114.

Naturally the present invention is not limited to the example and embodiment described and depicted but is capable of many variants accessible to persons skilled in the art.

For example, the various curves may be different according to the characteristics of the cells used and the characteristics of the electronic components constituting the processing unit. In particular the directions of variation may be reversed.

The curves may also be different if the first detection window of the first cell is aligned vertically with the second detection window of the second cell. However, there always exists a correspondence between the moment when the living being 114 no longer influences the first detection window of the first cell and the level of the electrical signal of the second type.

Although the invention is more particularly described in the case where the first detection window 504 of the first cell 502 is vertical, the invention can also function in the case where this detection window 504 is oriented horizontally.

The invention claimed is:

1. Device for counting and determining the direction of passage (500) of living beings (114), the device comprising:

(a) a first pyroelectric cell (502) adapted to deliver an electrical signal of a first type representing the infrared radiation emitted by a living being (114) passing in front of said first cell (502);

(b) a second pyroelectric cell (102) of the type comprising a first detection window (104) and a second detection window (106), and adapted to deliver an electrical signal of a second type representing the direction of passage of the living being (114) in front of said second pyroelectric cell (102), the first cell (502) and the second pyroelectric cell (102) being one above the other; and (c) a processing unit adapted to determine firstly the number of living beings passing in front of said device (500), by analyzing the electrical signal of the first type and, secondly, the direction of passage of the living beings (114) passing in front of said device (500) by analyzing the electrical signal of the first type and the electrical signal of the second type.

2. The device for counting and determining the direction of passage (500) of claim 1, wherein the first cell (502) is a pyroelectric sensor (502) of the type comprising a first detection window (504) and a second obscured detection window.

3. The device for counting and determining the direction of passage (500) of claim 2, wherein the determination of the direction of passage of the living beings (114) passing in front of said device (500) consists of analyzing the level of the electrical signal of the second type at the moment when the living being (114) leaves the cone of influence (506) of the first detection window (504) of the first cell (502).

4. The device for counting and determining the direction of passage (500) of claim 1, wherein the device comprises a cylindrical Fresnel lens (508) disposed in front of each cell (102, 502).

5. The device for counting and determining the direction of passage (500) according to claim 4, wherein, for each cell (102, 502), the position of the focus of the Fresnel lens (508) is such that the infrared radiation emitted by each living being (114) is focused substantially between the two detection windows (104, 106, 504) of the cell (102, 502) in question.

* * * * *

UNITED STATES PATENT AND TRADEMARK OFFICE

CERTIFICATE OF CORRECTION

PATENT NO. : 8,390,461 B2
APPLICATION NO. : 12/294776
DATED : March 5, 2013
INVENTOR(S) : Dubois et al.

It is certified that error appears in the above-identified patent and that said Letters Patent is hereby corrected as shown below:

Title Page:

Item (73) Assignee, delete "Eco Computeur" and insert --Eco Compteur-- therefor.

In the Claims:

Column 9, in Claim 5, line 6, delete "according to" and insert --of-- therefor.

Signed and Sealed this
Seventh Day of May, 2013

Teresa Stanek Rea
*Acting Director of the United States Patent and Trademark Office*